US006474612B2

(12) United States Patent
Ross, Jr.

(10) Patent No.: US 6,474,612 B2
(45) Date of Patent: Nov. 5, 2002

(54) POOL STICK HANGING DEVICE

(76) Inventor: Boyd E. Ross, Jr., R.D. 2 Box 369A, Mifflinburg, PA (US) 17844

( * ) Notice: Subject to any disclaimer, the term of this patent is extended or adjusted under 35 U.S.C. 154(b) by 0 days.

(21) Appl. No.: 09/751,733

(22) Filed: Dec. 29, 2000

(65) Prior Publication Data

US 2002/0084397 A1 Jul. 4, 2002

(51) Int. Cl.[7] ..... A47H 1/10
(52) U.S. Cl. ..... 248/317; 248/316.2; 211/68
(58) Field of Search ..... 348/317, 324, 348/325, 327, 316.2, 316.3, 113, 110; 211/68, 63, 66, 89.01, 104, 70.2, 70.6

(56) References Cited

U.S. PATENT DOCUMENTS

| | | | | | |
|---|---|---|---|---|---|
| 164,088 | A | * | 6/1875 | Hunter | 248/113 |
| 369,318 | A | * | 9/1887 | Craine | 248/113 |
| 824,149 | A | | 6/1906 | Ruddell | |
| 1,065,585 | A | | 6/1913 | Brothers | |
| 1,454,900 | A | * | 5/1923 | Leventry | 211/68 |
| 1,554,481 | A | | 9/1925 | Andreck | |
| 1,563,817 | A | * | 12/1925 | Wright | 248/113 |
| 2,370,876 | A | | 3/1945 | Richardson | |
| 4,003,612 | A | * | 1/1977 | Munsell | 312/245 |
| 4,103,780 | A | | 8/1978 | Winfree, Jr. | |
| D270,880 | S | | 10/1983 | Poland | |
| 5,033,614 | A | | 7/1991 | Hager | |
| 6,105,915 | A | * | 8/2000 | Naman et al. | 248/309.1 |
| 6,299,000 | B1 | * | 10/2001 | Cabrera | 211/70.2 |

* cited by examiner

*Primary Examiner*—Leslie A. Braun
*Assistant Examiner*—A. Joesph Wujciak, III

(57) ABSTRACT

A pool stick hanging device for straightening a warped pool stick. The pool stick hanging device includes a first bracket assembly being adapted to be suspended from a structure and including first and second stick engagement members; and also includes a second bracket assembly being adapted to engage a pool stick and including third and fourth stick engagement members.

11 Claims, 3 Drawing Sheets

POOL STICK HANGING DEVICE

BACKGROUND OF THE INVENTION

1. Field of the Invention

The present invention relates to a cue stick hanger and more particularly pertains to a new pool stick hanging device for straightening a warped pool stick.

2. Description of the Prior Art

The use of a cue stick hanger is known in the prior art. More specifically, a cue stick hanger heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,033,614; 4,103,780; U.S. Pat. No. Des. 270,880; U.S. Pat. Nos. 824,149; 1,065,585; 1,554,481; and 2,370,876.

While these devices fulfill their respective, particular objectives and requirements, the aforementioned patents do not disclose a new pool stick hanging device. The inventive device includes a first bracket assembly being adapted to be suspended from a structure and including first and second stick engagement members; and also includes a second bracket assembly being adapted to engage a pool stick and including third and fourth stick engagement members.

In these respects, the pool stick hanging device according to the present invention substantially departs from the conventional concepts and designs of the prior art, and in so doing provides an apparatus primarily developed for the purpose of straightening a warped pool stick.

SUMMARY OF THE INVENTION

In view of the foregoing disadvantages inherent in the known types of cue stick hanger now present in the prior art, the present invention provides a new pool stick hanging device construction wherein the same can be utilized for straightening a warped pool stick.

The general purpose of the present invention, which will be described subsequently in greater detail, is to provide a new pool stick hanging device which has many of the advantages of the cue stick hanger mentioned heretofore and many novel features that result in a new pool stick hanging device which is not anticipated, rendered obvious, suggested, or even implied by any of the prior art cue stick hanger, either alone or in any combination thereof.

To attain this, the present invention generally comprises a first bracket assembly being adapted to be suspended from a structure and including first and second stick engagement members; and also includes a second bracket assembly being adapted to engage a pool stick and including third and fourth stick engagement members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also it is to be understood that the phraseology and terminology employed herein are for the purpose of description an should not be regarded as limiting.

As such, those skilled in the art will appreciate that the conception, upon which this disclosure is based, may readily be utilized as a basis for the designing of the structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pool stick hanging device which has many of the advantages of the cue stick hanger mentioned heretofore and many novel features that result in a new pool stick hanging device which is not anticipated, rendered obvious, suggested, or even implied by any of the prior art cue stick hanger, either alone or in any combination thereof.

It is another object of the present invention to provide a new pool stick hanging device which may be easily and efficiently manufactured and marketed.

It is a further object of the present invention to provide a new pool stick hanging device which is of a durable and reliable construction.

An even further object of the present invention is to provide a new pool stick hanging device which is susceptible of a low cost of manufacture with regard to both materials and labor, and which accordingly is then susceptible of low prices of sale to the consuming public, thereby making such pool stick hanging device economically available to the buying public.

Still yet another object of the present invention is to provide a new pool stick hanging device which provides in the apparatuses and methods of the prior art some of the advantages thereof, while simultaneously overcoming some of the disadvantages normally associated therewith.

Still another object of the present invention is to provide a new pool stick hanging device for straightening a warped pool stick.

Yet another object of the present invention is to provide a new pool stick hanging device which includes a first bracket assembly being adapted to be suspended from a structure and including first and second stick engagement members; and also includes a second bracket assembly being adapted to engage a pool stick and including third and fourth stick engagement members.

Still yet another object of the present invention is to provide a new pool stick hanging device that is easy and convenient to set up and use for straightening out cue sticks.

Even still another object of the present invention is to provide a new pool stick hanging device that can be easily attached to an overhang or to a wall for allowing the cue stick to hang therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1A:
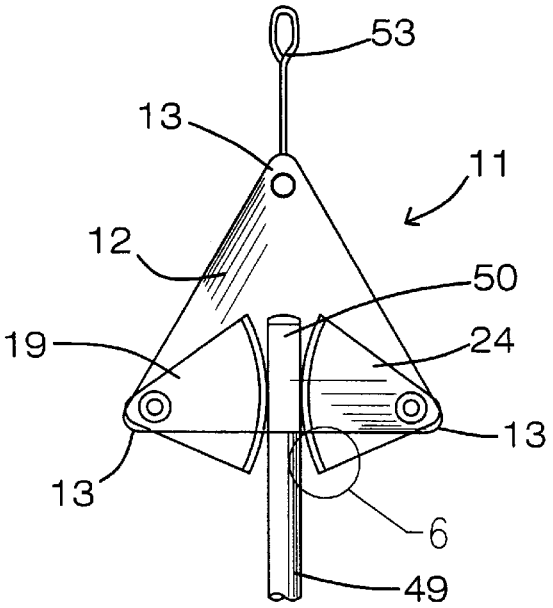
FIG. 1A is a front side elevational view of a first bracket member of a new pool stick hanging device according to the present invention.
Figure 1B:
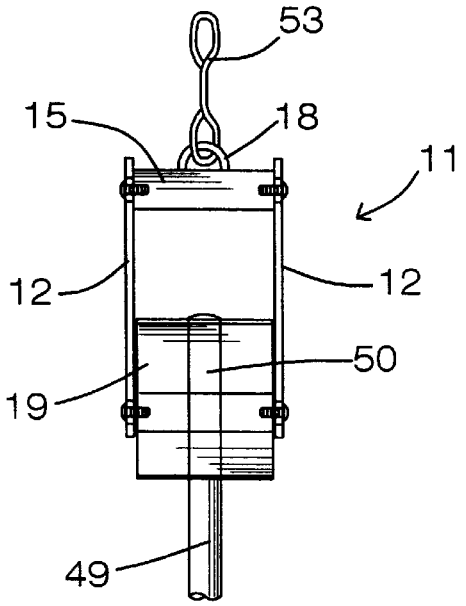
FIG. 1B is an end elevational view of the first bracket member of the present invention.
Figure 2:
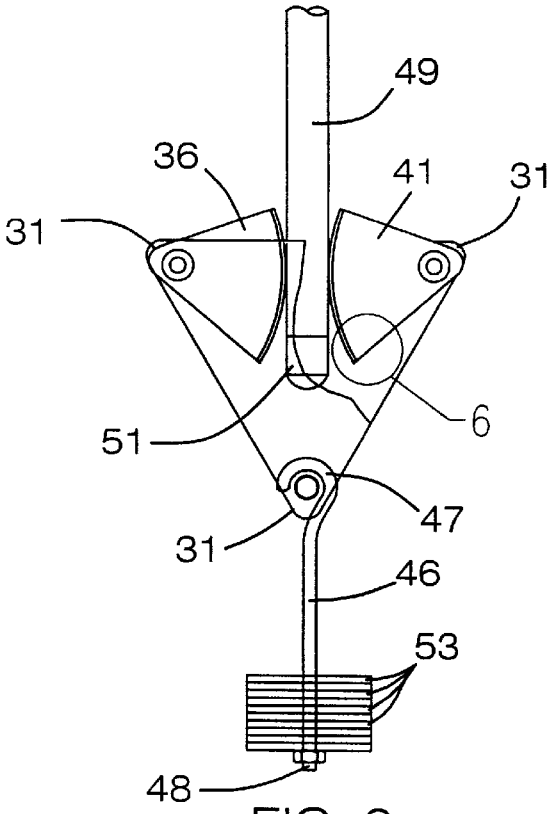
FIG. 2 is a front side elevational view of the present invention.
Figure 3:
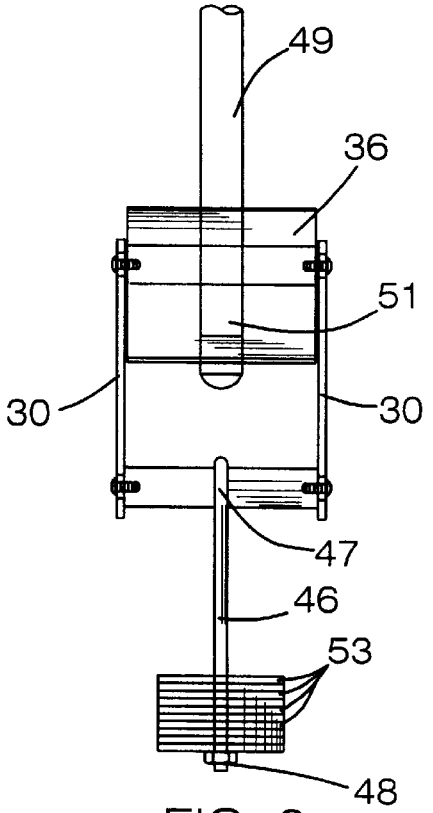
FIG. 3 is an end elevational view of the present invention.
Figure 4:
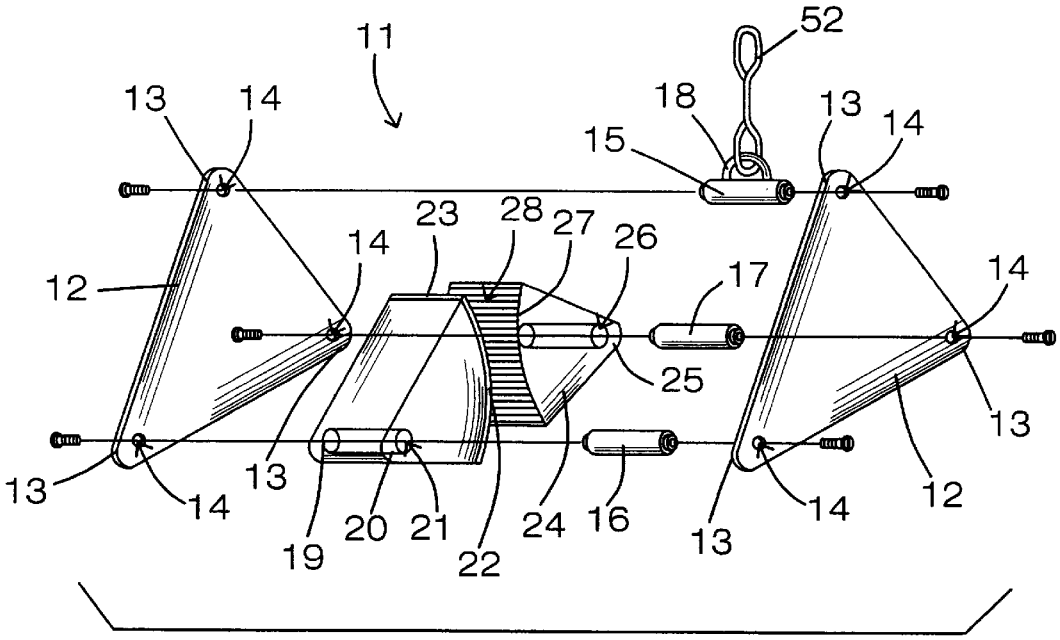
FIG. 4 is an exploded perspective view of the first bracket member of the present invention.
Figure 5:
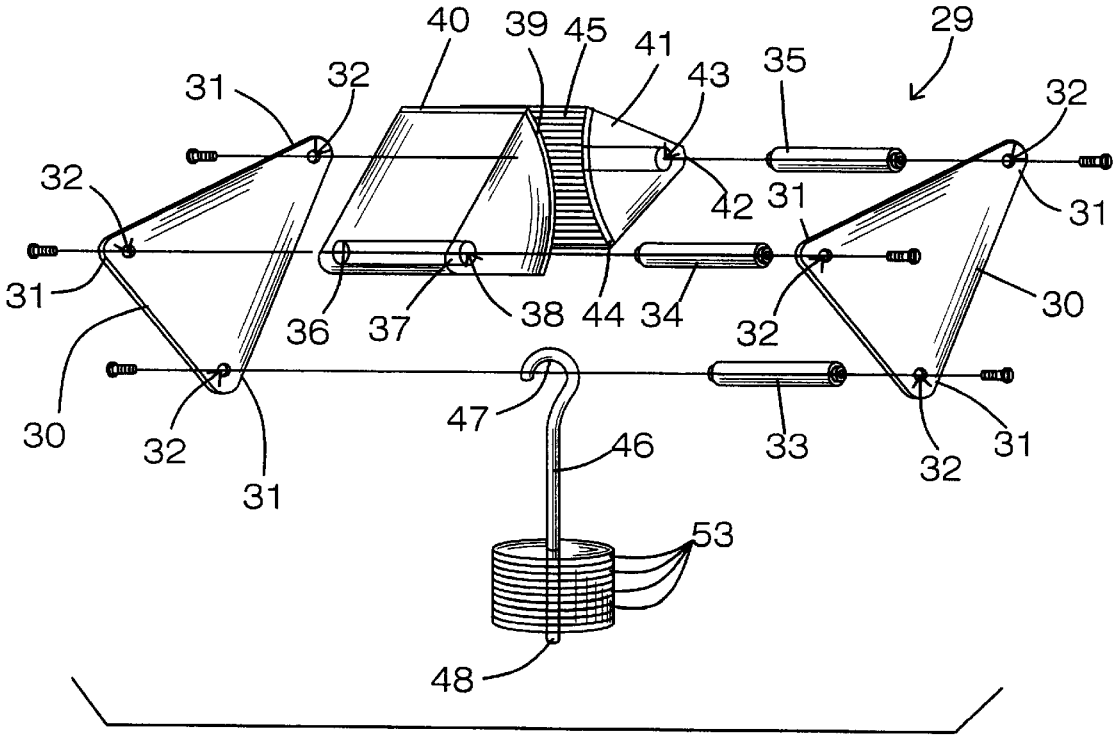
FIG. 5 is an exploded perspective view of the second bracket member of the present invention.
Figure 6:
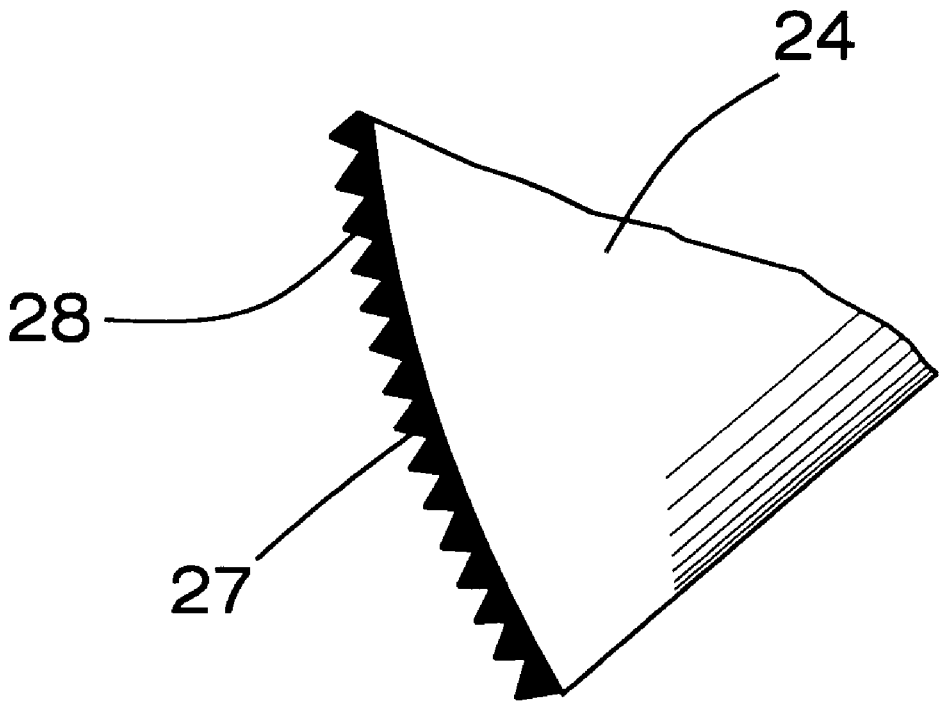
FIG. 6 is a partial side view taken from the perspective of the circled areas of FIGS. 1A and 2 showing a close up view of one of the stick engagement members of the present invention.

With reference now to the drawings, and in particular to FIGS. 1 through 6 thereof, a new pool stick hanging device embodying the principles and concepts of the present invention will be described.

As best illustrated in FIGS. 1 through 6, the pool stick hanging device generally comprises a first bracket assembly being adapted to be suspended from a structure and including first and second stick engagement members 19, 24. The first bracket assembly also includes a first bracket member 11 having side members 12 being spaced apart. The first bracket member 11 further has cross members 15–17 being attached with fasteners to the side members 12 and extending therebetween. The first and second stick engagement members 19, 24 are pivotally mounted to a respective one of the cross members 16, 17. The side members 12 are essentially triangular plate-like members having holes 14 near corners 13 thereof. The cross members 15–17 include first 15, second 16, and third cross members 17 being securely and conventionally attached at the corners 14 of the triangular plate-like members 12. The first cross member 15 has an eyelet 18 securely and conventionally attached and welded thereto and being adapted to attach to a chain 52 for suspending the first bracket assembly from the structure. Each of the first and second stick engagement members 19–24 is essentially a triangular-shaped cam having a vertex 20, 25 which has a bore 21, 26 disposed therethrough and which is pivotally mounted about a respective cross member 16, 17 and also has a curved side 22, 27 which is disposed opposite of the vertex 20, 25 with the curved side 22, 27 being conventionally covered with a first padded member 23, 28 having an outer corrugated surface for gripping the pool stick 49 near a ferrule end 50 thereof. The first and second stick engagement members 19, 24 are spaced apart and are adapted to engage and grip the pool stick 49 therebetween.

A second bracket assembly is adapted to engage a pool stick 49 and includes third and fourth stick engagement members 36,41. The second bracket assembly also includes a second bracket member 29 having side members 30 being spaced apart. The second bracket member 29 further has cross members 33–35 being attached with fasteners to the side members 30 and extending therebetween. The third and fourth stick engagement members 33–35 are pivotally and conventionally mounted to a respective one of the cross members 34,35 of the second bracket member 29. The side members 30 of the second bracket member 29 are essentially triangular plate-like members having holes 32 near corners 31 thereof. The cross members 33–35 of the second bracket member 29 include first 33, second 34, and third cross members 35 being securely attached at corners 31 of the triangular plate-like members 30 of the second bracket member 29. Each of the third and fourth stick engagement members 36,41 is essentially a triangular-shaped cam having a vertex 37,42 which has a bore 38,43 disposed therethrough and which is pivotally mounted about a respective cross member 34,35 of the second bracket member 29, and also has a curved side 39,44 which is disposed opposite of the vertex 37,42 with the curved side 39,44 being conventionally covered with a second padded member 40,45 having a corrugated outer surface for gripping the pool stick 49 near a butt end 51 thereof. The third and fourth stick engagement members 36,41 are spaced apart and are adapted to engage and grip the pool stick 49 therebetween. The second bracket assembly also includes a weight support member 46–48 being removably attached to the first cross member 33 of the second bracket member 29. The weight support member 46–48 includes a shaft 46 having a hook-like first end 47 which is hooked about the first cross member 33 of the second bracket member 29. The shaft 46 also has a second end 48 for supporting weights 53.

In use, the user engages the ferrule end 50 of the pool stick 49 between the first and second stick engagement members 19,24 and hangs or suspends the first bracket assembly 11 from a structure such as a wall, and then engages the butt end 51 of the pool stick 49 between the third and fourth stick engagement members 36,41 and suspends the second bracket assembly from the pool stick 49 while it hangs from the structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool stick hanging device comprising:

a first bracket assembly being adapted to be suspended from a structure and including first and second pivotal stick engagement members adapted to engage a first end of a pool stick; and a second bracket assembly being adapted to engage a second end of pool stick and including third and fourth pivotal stick engagement members;

wherein said first bracket assembly includes a first bracket member having side members being spaced apart, said first bracket member also having cross members being attached to said side members and extending therebetween, said first and second pivotal stick engagement members being pivotally mounted to a respective one of said cross members;

whereby the user may engage the first end of the pool stick between said first and second pivotal stick engagement members, whereby the user may engage the first end of the pool stick between said first and second pivotal stick engagement members, suspending the pool stick from the structure while the second end of the pool stick is engaged between the third and fourth pivotal stick engagement members.

2. A pool stick hanging device as described in claim 1, wherein said side members are essentially triangular plate members having holes near corners thereof.

3. A pool stick hanging device as described in claim 2, wherein said cross members include first, second, and third cross members being attached at said corners of said triangular plate members.

4. A pool stick hanging device as described in claim 3, wherein said first cross member has an eyelet securely attached thereto and being adapted to attach to a chain for suspending said first bracket assembly from the structure.

5. A pool stick hanging device as described in claim 3, wherein said second bracket assembly includes a weight support member being removably attached to said first cross member of said second bracket member, said weight support member including a shaft having a hook-like first end which is hooked about said first cross member of said second bracket member, said shaft also having a second end for supporting weights.

6. A pool stick hanging device as described in claim 1, wherein each of said first and second stick engagement members is essentially a triangular-shaped cam having a vertex which has a bore disposed therethrough and which is pivotally mounted about a respective said cross member, and also having a curved side which is disposed opposite of said vertex, said curved side being covered with a first padded member having an outer corrugated surface for gripping the pool stick near a ferrule end thereof, said first and second stick engagement members being spaced apart and being adapted to engage and grip the pool stick therebetween.

7. A pool stick hanging device as described in claim 1, wherein said second bracket assembly includes a second bracket member having side members being spaced apart, said second bracket member also having cross members being attached to said side members and extending therebetween, said third and fourth stick engagement members being pivotally mounted to a respective one of said cross members of said second bracket member.

8. A pool stick hanging device as described in claim 7, wherein said side members of said second bracket member are essentially triangular plate members having holes near corners thereof.

9. A pool stick hanging device as described in claim 7, wherein said cross members of said second bracket member include first, second, and third cross members being securely attached at said corners of said triangular plate members of said second bracket member.

10. A pool stick hanging device as described in claim 1, wherein each of said third and fourth stick engagement members is essentially a triangular-shaped cam having a vertex which a bore disposed therethrough and which is pivotally mounted about a respective said cross member of said second bracket member, and also having a curved side which is disposed opposite of said vertex, said curved side being covered with a second padded member having a corrugated outer surface for gripping the pool stick near a butt end thereof, said third and fourth stick engagement members being spaced apart and being adapted to engage and grip the pool stick therebetween.

11. A pool stick hanging device comprising:

a first bracket assembly being adapted to be suspended from a structure and including first and second stick engagement members, said first bracket assembly including a first bracket member having side members being spaced apart, said first bracket member also having cross members being attached to said side members and extending therebetween, said first and second stick engagement members being pivotally mounted to a respective one of said cross members, said side members being essentially triangular plate-like members having holes near corners thereof, said cross members including first, second, and third cross members being securely attached at said corners of said triangular plate-like members, said first cross member having an eyelet securely attached thereto and being adapted to attach to a chain for suspending said first bracket assembly from the structure, each of said first and second stick engagement members being essentially a triangular-shaped cam having a vertex which has a bore disposed therethrough and which is pivotally mounted about a respective said cross member, and also having a curved side which is disposed opposite of said vertex, said curved side being covered with a first padded member having an outer corrugated surface for gripping the pool stick near a ferrule end thereof, said first and second stick engagement members being spaced apart and being adapted to engage and grip the pool stick therebetween; and a second bracket assembly being adapted to engage a pool stick and including third and fourth stick engagement members, said second bracket assembly including a second bracket member having side members being spaced apart, said second bracket member also having cross members being attached to said side members and extending therebetween, said third and fourth stick engagement members being pivotally mounted to a respective one of said cross members of said second bracket member, said side members of said second bracket member being essentially triangular plate-like members having holes near corners thereof, said cross members of said second bracket member including first, second, and third cross members being securely attached at corners of said triangular plate-like members of said second bracket member, each of said third and fourth stick engagement members being essentially a triangular-shaped cam having a vertex which has a bore disposed therethrough and which is pivotally mounted about a respective said cross member of said second bracket member, and also having a curved side which is disposed opposite of said vertex, said curved side being covered with a second padded member having a corrugated outer surface for gripping the pool stick near a butt end thereof, said third and fourth stick engagement members being spaced apart and being adapted to engage and grip the pool stick therebetween, said second bracket assembly including a weight support member being removably attached to said first cross member of said second bracket member, said weight support member including a shaft having a hook-like first end which is hooked about said first cross member of said second bracket member, said shaft also having a second end for supporting weights.

* * * * *